United States Patent [19]

Schippers et al.

[11] Patent Number: 4,561,602

[45] Date of Patent: Dec. 31, 1985

[54] METHOD AND APPARATUS FOR FACILITATING DOFFING OF A YARN PROCESSING MACHINE

[75] Inventors: Heinz Schippers; Gerd Münnekehoff, both of Remscheid, Fed. Rep. of Germany

[73] Assignee: Barmag Barmer Maschinenfabrik Aktiengesellschaft, Remscheid, Fed. Rep. of Germany

[21] Appl. No.: 563,024

[22] Filed: Dec. 19, 1983

[30] Foreign Application Priority Data

Dec. 18, 1982 [DE] Fed. Rep. of Germany ..... 3247020
Jul. 27, 1983 [DE] Fed. Rep. of Germany ..... 3326980
Sep. 9, 1983 [DE] Fed. Rep. of Germany ..... 3332568

[51] Int. Cl.[4] ..... B65H 54/20; B65H 54/26; B65H 67/04

[52] U.S. Cl. ..... 242/35.5 A; 242/18 DD; 242/18 PW; 242/35.5 R; 57/269; 57/303

[58] Field of Search ..... 242/35.5 A, 35.5 R, 242/35.6 R, 18 R, 18 PW, 18 G, 18 DD, 18 A, 41; 57/269, 303

[56] References Cited

U.S. PATENT DOCUMENTS 2,266,121 12/1941 Kinsella et al. ..... 242/35.5 R
3,857,523 12/1974 Lenderman ..... 242/18 PW X
3,895,725 7/1975 Mayer ..... 242/41
3,987,974 10/1976 Mayer ..... 242/35.5 A
4,007,884 2/1977 Schippers et al. ..... 242/41
4,062,501 12/1977 Eisenberg et al. ..... 242/18 A X
4,153,211 5/1979 Lenk et al. ..... 242/35.5 A
4,166,586 9/1979 Shirasuna et al. ..... 242/18 DD X
4,340,187 7/1982 Schippers et al. ..... 242/35.5 A
4,451,007 5/1984 Ohkubo et al. ..... 242/18 A X

FOREIGN PATENT DOCUMENTS 2935366 3/1981 Fed. Rep. of Germany .
3227978 3/1983 Fed. Rep. of Germany .
1297791 11/1972 United Kingdom .
1399891 7/1975 United Kingdom .

*Primary Examiner*—Stanley N. Gilreath
*Attorney, Agent, or Firm*—Bell, Seltzer, Park & Gibson

[57] ABSTRACT

A method and apparatus for continuously removing waste yarn during doffing of a textile yarn processing machine is disclosed, which includes a mobile carriage which is adapted to move to a position adjacent a winding station to be doffed. The carriage mounts a waste yarn take-up spool, and yarn transfer means for moving the advancing yarn from the winding station to the take-up spool. After doffing the full package, the yarn transfer means moves the advancing yarn back to the empty bobbin, and the carriage is then free to move to the next winding station. The waste yarn wound on the take-up spool may be advantageously used for quality control measurements.

22 Claims, 8 Drawing Figures

METHOD AND APPARATUS FOR FACILITATING DOFFING OF A YARN PROCESSING MACHINE

Figure 1:
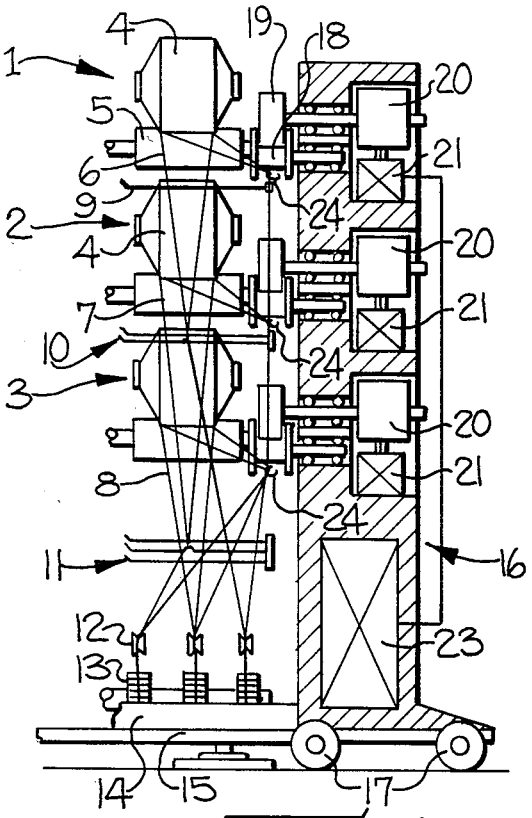

The present invention relates to a method and apparatus for continuously removing waste yarn during doffing of a textile yarn processing machine of a type having a plurality of yarn winding stations aligned along at least one side thereof, and wherein the yarn continues to advance during the doffing operation.

Textile machines having a plurality of positions for producing or processing yarn, such as yarn texturing machines, typically have a plurality of winding stations arranged in horizontal tiers and vertically aligned columns. The yarns are delivered to all of the winding stations in a vertical direction and from one vertical end of the apparatus, and the yarns are then distributed to the individual winding stations from a position horizontally in front of each station. Where it is not possible or unsuitable to interrupt the advance of the yarns while doffing, it is necessary to remove the yarns from the traverse motion systems associated with the winding stations, and to remove the yarns in some way as waste. For example, it is known to remove the yarns with suction systems during doffing, which direct the yarns to a waste container, note German OS No. 29 35 366. It is also known to equip the machine with separate waste spools, which are associated with each winding station.

Yarn processing machines of the type having waste spools at each winding station have the disadvantage that in addition to doffing the full packages, a corresponding number of waste spools must be replaced from time to time, or that the yarn must be removed from the waste spools. To alleviate this disadvantage, it has been proposed to operate the entire textile machine at a reduced speed while doffing, note U.S. Pat. No. 4,451,007, to thereby keep the length of yarn wound as waste to a minimum. This however results in a loss of valuable production time at stations not being doffed, and in addition, the operating parameters of the apparatus may change, such as for example the amount of heat applied to the yarn in a long heating chamber.

The above disadvantages are effectively alleviated with the present invention, which relates to a method and apparatus which includes a mobile carriage which is adapted to be moved to a position adjacent a yarn winding station at the conclusion of the winding operation at such station. The carriage mounts a yarn take-up spool, which is adapted to be rotated at a winding speed which closely corresponds to the winding speed of the yarn processing machine. Also, the carriage preferably includes yarn transfer means whereby the advancing yarn at the adjacent winding station may be transferred to the take-up spool on the carriage, and so as to sever the yarn between the winding station and take-up spool. At the completion of the doffing operation, the advancing yarn may be returned from the take-up spool on the carriage to the empty bobbin, and so that the yarn is again severed between the take-up spool and winding station. In a preferred embodiment, the carriage further includes means for traversing the advancing yarn along the surface of the take-up spool during winding of the yarn thereon, so that the yarns are wound into packages on the spool with favorable unwinding properties, and thus the yarn need not be removed by force, such as with a blade or the like.

The take-up spool may have an axial drive, and in such case, the drive should be equipped with a regulating system which insures an essentially constant circumferential speed. In the absence of a regulating system, the speed control may be accomplished by a slip drive or a drive roll. In the latter case, the drive roll is adapted to drive the take-up spool on the circumference of the yarn, and thus at a constant speed. With the use of a slip drive, an axial drive is employed, the motor or coupling of which slips as a function of the torque, thereby providing a decreasing drive speed at an essentially constant yarn tension and at an increasing package diameter.

In accordance with the present invention, the textile yarn processing machine may be doffed as follows. As soon as there is a full package on a winding unit, i.e. when the winding cycle for a package has been completed, the auxiliary carriage with the take-up spool moves to a position adjacent the yarn winding station having the full package. The drive unit for the take-up spool is then started, and the advancing yarn is manually or mechanically transferred to the take-up spool. The yarn is severed during the transfer, and it is then wound at its operating speed onto the take-up spool, and preferably it is also reciprocated by a traverse motion system. At this point, the drive of the full package can be shut down, and the full package may be braked to permit it to be removed from its package support. An empty bobbin may then be placed on the package support and the station again started. The advancing yarn is then transferred from the take-up spool to the empty bobbin, where it is caught and severed between the take-up spool and empty bobbin. While these transfer steps may be done by hand, it is preferred to equip the carriage with yarn transfer means, which transfer the yarn between the winding station and take-up spool. It is also preferred to equip the carriage with means for removing the full package and inserting the empty bobbin at the winding station.

In one preferred embodiment, one take-up spool is arranged on the auxiliary carriage in association with each tier of the winding stations. For this purpose, a waste winding unit may be respectively arranged at about the same height as each tier of the apparatus. However, it is also possible to arrange a number of waste yarn winding units corresponding to the number of winding tiers juxtaposed at the same height and in front of the upstream winding tier, viewed in the direction of yarn advance. In this case, the packages may be simultaneously doffed on all winding stations of a given column, and this results in the possibility of providing identical travel lengths for all winding stations. For this purpose, once a predetermined operating time has elapsed, the winding stations of a given column are concurrently stopped and doffed in a predetermined time cycle, and it is thus necessary, in contrast to known textile machines, to discard only the yarns of this column as waste. Then an adjacent column of winding stations is doffed, and the yarns coming from several winding stations juxtaposed in one tier are respectively wound on one take-up spool and in such a manner, for example, that one take-up spool receives the yarns of one winding tier and of one section of the textile machine.

It is also possible and advantageous to employ the auxiliary carriage in a random doffing procedure, and it is further possible to equip the carriage with package carrying means, to facilitate the removal of the full packages. Such package carrying means are described for example in German OS No. 32 27 978. As there described, the package carrying means is respectively associated with each tier of the winding stations, and it is adapted to be moved vertically to the machine front so that the package carrying means may move below each full package. The carrying means serves to facilitate the removal of the heavy yarn packages from the machine. Similarly, it is possible to connect the auxiliary carriage of the present invention with an automatic doffer which automatically removes the full yarn packages and replaces them with empty bobbins. The carrying means may also have supporting means, which raise the conventional U-shaped package levers, in which the full packages are clamped, from their respective drive roll. It is also possible to provide these carrying means with lateral brake stops, which move against the rotating parts of the winding station so as to brake the rotation, or to move against switches which actuate for example a pneumatic, electric, or mechanical brake.

The invention is particuarly advantageous in that it facilitates quality control. The quality control of textured yarns typically comprises the determination of yarn fineness, crimps, elongation, and strength. For this purpose, the present invention contemplates that the yarn produced during a doff of the packages and which is wound on a waste take-up spool under operating conditions, i.e. at essentially the same winding speed and under a simultaneous traversing motion, may be submitted to quality control in the form of the waste yarn package. A particular advantage is that such quality control may be performed immediately after the production of a package. Also, the full production packages can be immediately prepared for shipment upon their removal from the textile machine, without it being necessary to remove a yarn sample from each package or at random for quality control. Rather, with the present invention, the yarns wound on the waste take-up spool serve as samples such as, for example, the yarns coming from a horizontal tier of winding stations of a section. It is preferred that the measured quality data of the yarns wound on a take-up spool be associated to a certain yarn length, so that it is also possible to associate the quality data to certain previously marked packages.

Figure 1A:
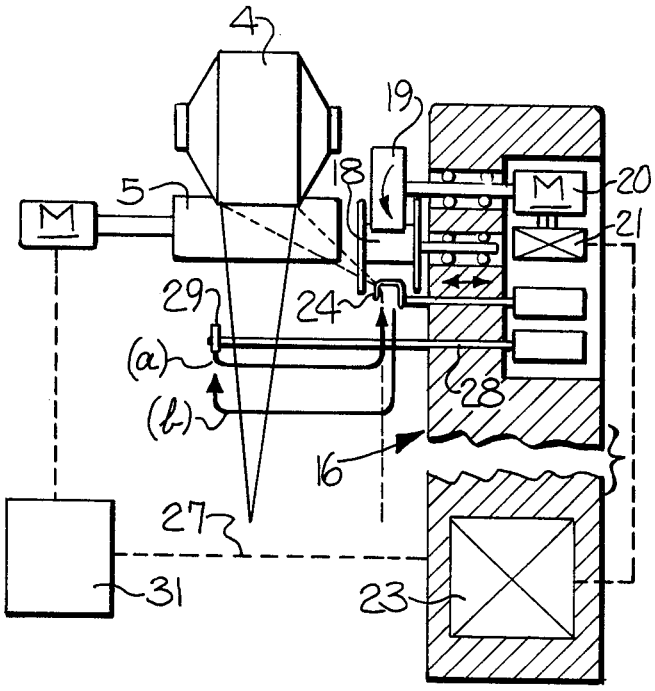
Figure 1B:
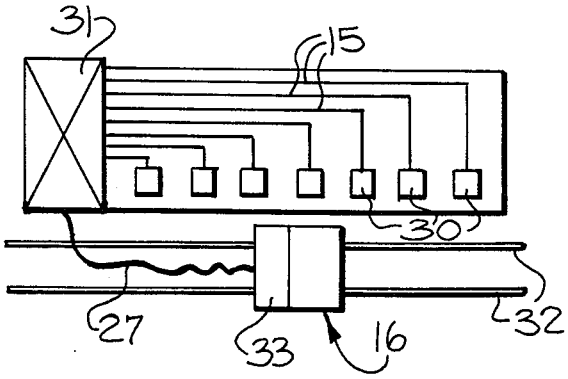
Figure 3:
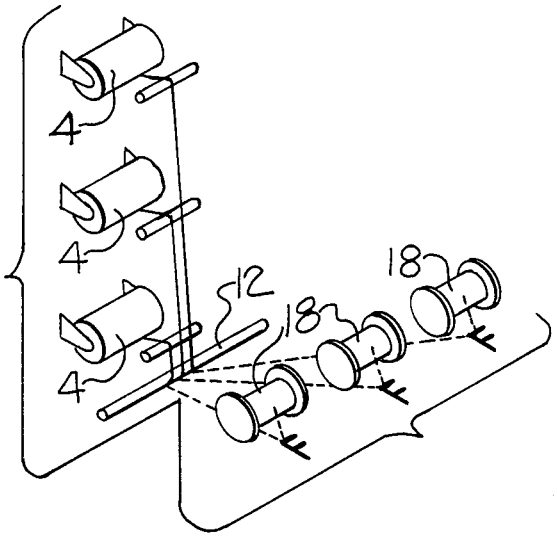

Some of the objects and advantages of the invention having been stated, others will appear as the description proceeds, when taken in connection with the accompanying drawings, in which FIG. 1 is a schematic sectional side elevation view of an apparatus embodying the features of the present invention positioned in operative engagement with several yarn winding stations of a yarn processing machine;

FIG. 1*a* is a fragmentary view similar to FIG. 1;

FIG. 1*b* is a schematic top plan view of a textile winding machine, together with the mobile apparatus of the present invention;

FIGS. 2*a*–2*d* are fragmentary perspective views which schematically illustrate the steps of the method for continuously removing waste yarn in accordance with the present invention; and FIG. 3 schematically illustrates an embodiment wherein the carriage of the present invention mounts a number of take-up spools corresponding to the number of winding stations in each vertical column.

Referring more particularly to the drawings, FIG. 1 schematically illustrates one vertical column of winding stations of a textile yarn processing machine, mounted on the machine frame 15. The winding stations are arranged in three tiers, 1, 2, and 3 which are disposed in the vertical column, and it will be understood that the yarn processing machine includes a plurality of similar winding stations which are distributed in aligned tiers and vertical columns along the machine front.

Each of the winding stations comprises a U-shaped package holder (not shown), in which the bobbin of the package 4 is clamped. The package 4 rests on a drive roll 5, and the drive roll is driven at a constant speed by a motor M (FIG. 1*a*). A conventional traverse motion device (not shown) is associated with each winding station and precedes each package in the direction of yarn advance. The yarns 6, 7, 8, which are supplied to the winding stations in a given column initially move in a horizontal direction and adjacent to each other and across the oiling rolls 13 which apply a finishing fluid to the yarns from the trough 14. The yarns are then deflected by a yarn guide 12 essentially upwardly, and they are then distributed individually to the guide rods 11, 10, and 9. The yarns 6, 7, and 8 then approach their respective winding stations and form a traversing triangle between the yarn guide 12, or the yarn guide grooves in one of the guide rods 10 and 11, and the respective package. Guide rods 9, 10, 11 are used to guide the yarns along the machine front in three separate vertical planes, so that the yarns do not contact each other, and in addition the guide rods serve to deflect the yarns in front of the respective take-up packages from a vertical plane to an inclined or horizontal traversing plane.

It should be noted that for the purpose of doffing packages, the yarn path should be maintained, since the doffing speed, the production of waste during doffing, and the loss of operating time as a result of doffing are dependent thereon. In particular, it is desirable that the yarns should not be removed from the oiling rolls 13 and from the yarn deflecting guide 12.

The auxiliary carriage 16 is adapted to move on wheels 17 along the machine front between the columns of winding stations. In accordance with the present invention, the auxiliary carriage 16 has at least one waste take-up spool 18, and in the embodiment of FIG. 1, there is one spool associated with each winding station in the illustrated column. The take-up spools are preferably removably mounted on the carriage, and they are freely rotatable and driven by drive rolls 19. A motor 20 and control system 21 is associated with the drive rolls so as to rotate the same at a constant circumferential speed, and each control system 21 is operatively connected to the central control unit 23 mounted on the carriage. The speed of the drive rolls 19 is also preferably controlled so as to closely correspond to the winding speed of the winding stations. Also, as will be understood, the drive roll and the waste take-up spool are adapted to move relative to each other so as to take into account the increasing diameter of the waste yarn package.

As an alternative to the drive roll 19, each spool may be driven by a slip motor or a slip coupling which can be provided for driving the spool at an essentially constant yarn tension as a function of the increasing package diameter and decreasing speed. As a further alternative embodiment, and as illustrated schematically in FIG. 3, the carriage may mount a number of take-up spools 18 and guides corresponding to the number of winding stations in each vertical column (three in the illustrated embodiment), with such take-up spools being juxtaposed horizontally and disposed in front of the upstream winding tier when viewed in the direction of yarn advance. In this embodiment, the spools 18 and guides are mounted at a fixed location with respect to the carriage, and they remain horizontally aligned with the upstream winding tier during the doffing process.

As illustrated schematically in FIG. 1*a*, the carriage 16 may be physically interconnected to the textile machine by a flexible electrical cable 27 or the like, whereby the winding speed of the motor M of the adjacent winding station may be monitored and fed to the central control unit 23, and so that the speed of each motor 20 may be controlled as a function of the monitored speed so that the winding speed of the take-up spool closely corresponds to the winding speed of the adjacent winding station. The carriage 16 further mounts yarn transfer means for transferring the advancing yarn from the adjacent winding station to the take-up spool prior to doffing and for returning the advancing yarn from the spool to an empty bobbin at the adjacent station after doffing is completed. The transfer means may comprise known, program controlled handling devices, which are installed on the auxiliary carriage 16 and which are respectively associated with one or all tiers of the winding units. In general, the displacement and position of these handling units may be predetermined and controlled, and the end positions to be reached, the yarn speeds, and the individual motions to be carried out for grasping and deflecting the yarn can be freely programmed.

The path of displacement and the positioning can further be controlled, monitored or regulated by sensors. However, the transfer means may also comprise several components mounted on the carriage 16 and provided with individual drives and firmly predetermined movements. As a typical example as illustrated schematically in FIG. 1*a*, the transfer means may comprise a rod 28 mounting a yarn engaging collar 29 which moves along the path (a) for transferring the yarn from the winding station to the take-up spool, and along the reverse path (b) to transfer the yarn from the spool to the package. Such yarn transfer means is preferably associated with each tier of the winding units 1, 2, and 3. The collar 29 is arranged and adapted to move along path (a) so as to reach behind the yarn in its traversing triangle to the package 4, to lift the yarn from its traverse motion device, and move the yarn to the traverse motion device 24 associated with the waste take-up spool. The transfer means may also guide the yarn in a lateral path (not shown) so that the yarn will not interfere with the doffing of a full package or the replacement of an empty tube. The path of displacement performed by the transfer means is such that the yarn also contacts the flanges of the spool 18, when it is moved to the traverse motion device 24. The flanges are provided with notches, which engage the yarns and so tension it by the rotation of the spool that the yarn is severed between the notches and the package 4. Each of the yarns is then wound on a waste spool 18. At this point, the wound packages 4 can be removed from their holders and new empty bobbins may be replaced in the holders and brought into circumferential contact with the drive rolls 5, which are in constant operation. The yarn transfer means then becomes again active, and it reaches behind the yarns being supplied to the take-up spools, and returns the same along path (b) in FIG. 1*a* to the associated rotating empty bobbin. The yarn is thus removed from the traverse motion device 24 and is caught by the traverse motion device which is located upstream of the winding unit. Also, the yarn is again severed between the spool and empty bobbin, either by contact with the notched flange of the spool or by tension.

The auxiliary carriage 16 is then free to move to another column of winding units, and the yarns being there produced during the package doffing operation are also wound on the take-up spools. In this manner, it is possible to successively wind on a single waste spool the yarns from a number of winding stations.

The auxiliary carriage of the present invention is suitable for either a fixed cycle doff or a random doff. In a fixed cycle doff, it is understood that within a predetermined doffing time, all of the winding units of the textile machine are successively doffed by columns. A random doff refers to a procedure where only winding stations with full packages, or with an end down, are doffed. The waste take-up spool 18 is preferably a flanged spool, with one flange being detachable.

FIG. 1*b* schematically illustrates a yarn winding machine having a frame 15, a plurality of winding stations 30, and a control unit 31. A trackway 32 extends along one side of the machine which mounts a carriage 16 in accordance with the present invention, together with a doffing apparatus 33 which may be fixed to the carriage and as further described below.

In the embodiment of FIGS. 2*a*–2*d*, the heater 22 of the textile machine is illustrated, as well as a portion of the winding stations. The yarns 6, 7, and 8 move through the heater from top to bottom, and are deflected under the heater so as to be directed into contact with the oiling rolls 13. The oiling rolls 13 rotate in a trough filled with a suitable finishing fluid, which is applied to the yarns by the rolls. Thereafter, the yarns 6, 7, and 8 are deflected by the guide rod 12 to a vertical direction, so that they travel upwardly toward the column of packages 4. Each of the packages 4 is driven by a drive roll 5 at a constant peripheral speed, and a guide rod 9, 10, or 11 precedes respective ones of the drive roll or package.

Figure 2B:
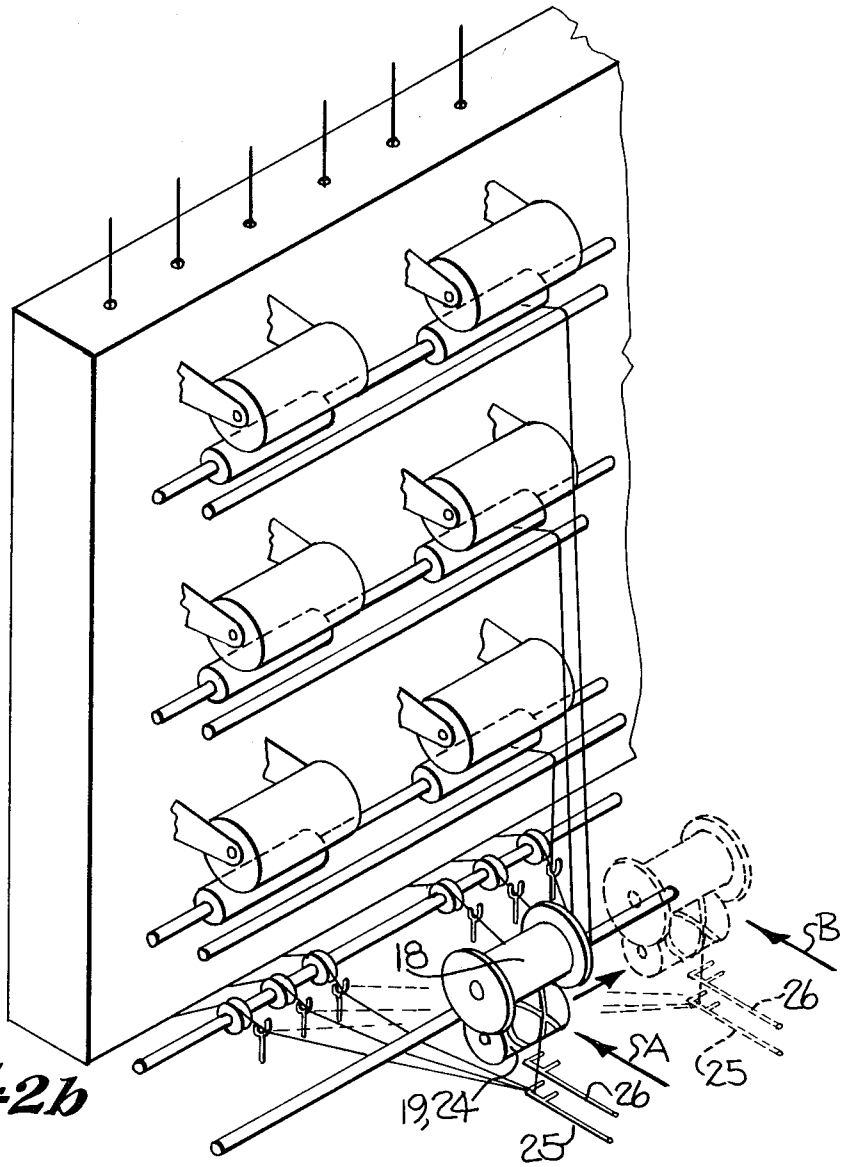
Figure 2A:
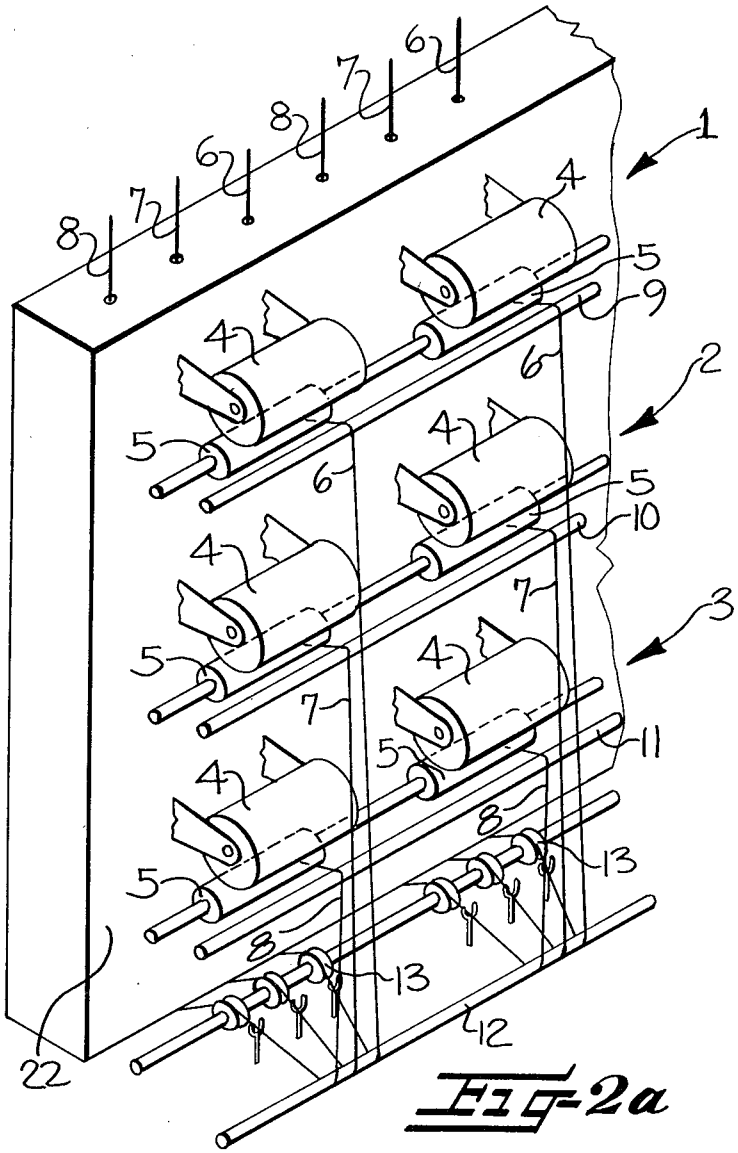
Figure 2D:
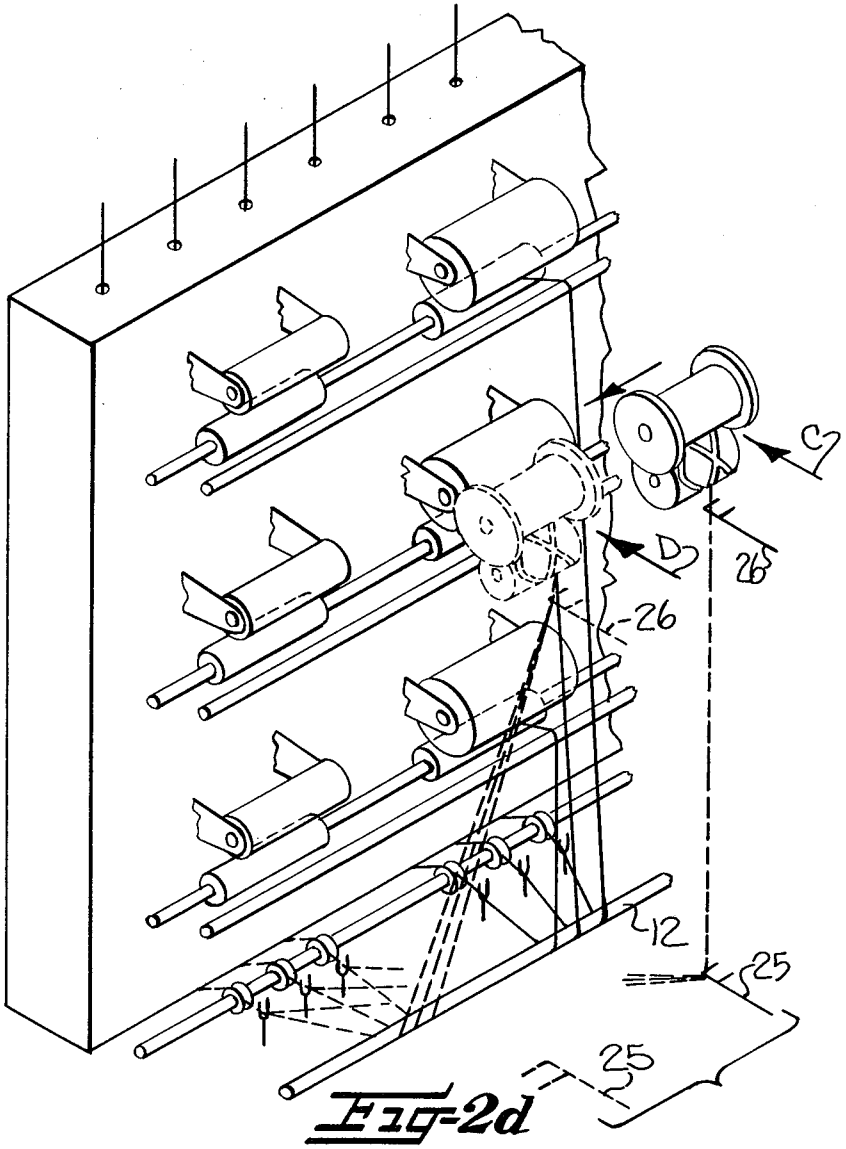

The operation of the auxiliary carriage will be described in conjunction with FIGS. 2*b*–2*d*. The auxiliary device itself is not shown in these figures for clarity of illustration, but it will be understood to comprise a small carriage which is adapted to travel automatically along a path parallel to the machine front. A suitable trackway may if desired be provided for this purpose. A waste spool 18 is rotatably mounted on the carriage, and is driven by a drive roll 19 at a constant peripheral speed which closely corresponds to that of the drive rolls 5 of the textile machine. The drive roll 19 is provided with yarn traversing grooves and therefore simultaneously serves as a traverse motion device. The carriage supports two yarn guides 25, 26 in a vertical arrangement.

Upon the left column of winding units being shut down as shown in these figures, the yarn 6, 7, and 8 traveling along this column are concurrently engaged by a suitable mechanical transfer device, or by hand, and guided through the yarn guides 25, 26, and then placed on drive roll 19 and spool 18. Thereafter, the waste yarn winding unit moves from its initial position A, which is generally in alignment with the lowermost winding station of the left column of stations, to an intermediate position B which is sufficiently removed in the lateral direction so that the left column of winding stations is fully exposed. Next, the package holders can be released and the packages 4 of the left column may be removed. A new empty bobbin may then be clamped in the package holders and brought into contact with the drive rolls. For this purpose, a special package carrying and doffing device may be used of the type described in German OS No. 32 27 978, and as illustrated schematically in FIG. 1*b* at 33. The package carrying apparatus disclosed in this German patent is adapted to move on rails along the machine front, and it includes a plurality of package receiving devices aligned in a vertical row so that the devices are aligned in front of respective winding stations of the vertical column of stations on the winding machine. Each package receiving device is adapted to be shifted forwardly to receive a full package from the associated station, and then shifted rearwardly to withdraw the full package from the winding station. At the withdrawn position, the packages may be readily removed and deposited onto a transport carriage, such as the carriage 4 in FIG. 1 of U.S. Pat. No. 4,153,211 or carriage 31 in FIG. 2 of U.S. Pat. No. 4,340,187. The package carrying apparatus as disclosed in the above referenced German patent may also be modified so that the package receiving devices are pivotable about a vertical axis, for providing better access to the bobbin tube by a bobbin handling mandrel (not shown) which is designed to coaxially enter the bobbin tube. This vertical pivot axis preferably is positioned behind the auxiliary carriage 16, so that the package carrying apparatus would not interfere with the carriage 16. With the use of this type of package carrying apparatus, the packages may be removed and brought from the operational area of the column of stations that is being doffed.

Figure 2C:
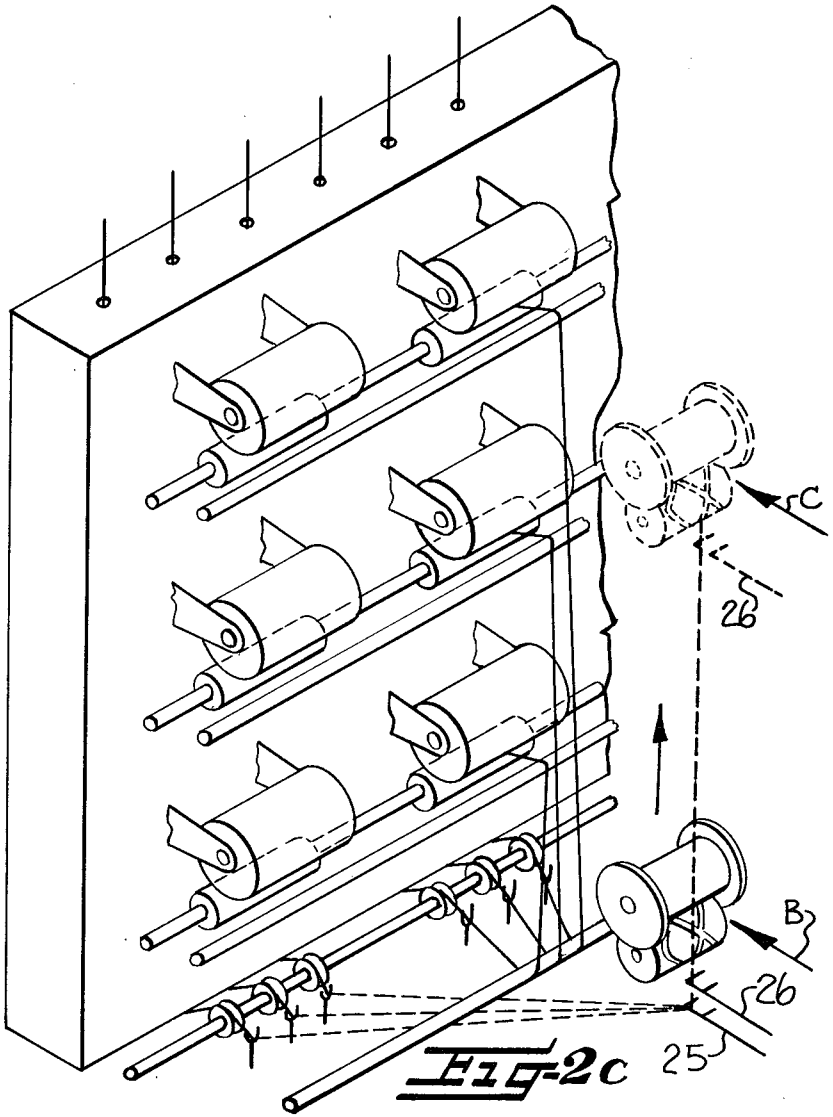

Referring now to FIG. 2*c*, the waste take-up spool and its drive roll, as well as the upper yarn guide 26, move upwardly in the vertical direction and have been brought to an upper intermediate position C. As further shown in FIG. 2*d*, empty bobbins have at this point been placed in the package holders of the left column of winding stations, and brought into contact with the drive rolls 5. At this point, the waste take-up spool, with its drive roll, moves in a lateral horizontal direction to final position D, which is again aligned with the left column of winding stations. The yarns are then released from the yarn guide 25 by pivoting through 180° as shown in FIG. 2*d*, so that the yarns slip from the guide 25. The yarns then again individually engage deflecting rod 12 and move to the yarn guide 26, and they can be placed by hand or with the use of a suitable yarn transfer device onto the bobbins. A new winding cycle is then started. Subsequently, the waste yarn winding unit and both the yarn guide 26 and yarn guide 25 are brought to the initial position shown in FIG. 2*b*. The auxiliary carriage may then move by one increment, i.e., to an adjacent column of winding stations and the entire cycle is repeated.

The above embodiments of the present invention provide significant advantages. Specifically, the technical problem of building a waste yarn package during a package doff is simplified in that only a single waste yarn handling unit is required for a column of winding stations. Further, a suitable sequence of motions is provided, which permits the doffing of packages without interference by the waste yarn winding unit. Also, it is possible to equip the auxiliary carriage with suitable doffing means, which may remove the full packages and/or place empty bobbins in the package holders.

In the event a waste yarn package is used for quality control it may be conducted simultaneously for three yarns, which increases in the example troubleshooting to three working positions, but this can be economically justified by the need for less mechanical and technical resources. Further, it is possible to provide only one waste take-up spool for a column of winding units.

A particular advantage of the auxiliary carriage of the present invention resides in the fact that the waste yarn winding units can provide an important function in the quality control of the produced yarns. Normally, quality control involves a sample being taken from all produced packages, or at random. This sample may then be wound by hand or taken to the laboratory. Only upon completion of the quality control can the packages be further processed or be processed for shipment. Since it is provided by the present invention that the waste yarn packages are essentially wound under production conditions, so that the quality of the wound yarns essentially corresponds to that of the produced yarns, it is provided that the waste yarn packages of the present invention may be submitted to quality control. This reduces the time needed for the quality control, and it is possible to transport the produced packages to the shipping department without interruption of material flow.

During quality control, the yarn lengths on the waste spool may be physically marked or otherwise identified so that each length may be correlated with the winding station from which it came. Also, each package may be similarly marked or identified to permit correlation with its winding station. The measured qualitative data are then associated with the yarn lengths, so that an association to certain winding stations and packages produced thereon is also possible. If, as is preferred, several yarns are successively wound on a waste spool, the yarns may be successively unwound for quality control, with the quality measurements being taken as much as possible by measuring devices which work continuously on the running yarn and the data obtained may be provided with the simultaneously measured yarn lengths. By way of the yarn lengths, the measured data can be associated to the previously marked packages, so that the packages can be subsequently sorted by quality. This method of carrying out quality control is also effective where the waste yarn winding units are fixedly mounted on the textile machine.

In the drawings and specification, there has been set forth preferred embodiments of the invention, and although specific terms are employed, they are used in a generic and descriptive sense only and not for purposes of limitation.

That which is claimed is:

1. A method for continuously removing waste yarn during doffing of a textile yarn processing machine having a plurality of yarn winding stations aligned along at least one side thereof, and wherein the yarn continues to advance during the doffing operation, and comprising the steps of moving a mobile carriage to a position adjacent a yarn winding station at the conclusion of the winding operation at such station, transferring the advancing yarn from the winding station to a take-up spool mounted on said carriage, while rotating the take-up spool and so as to wind the yarn thereupon, and including severing the yarn between the winding station and take-up spool, removing the full bobbin from the adjacent yarn winding station and replacing the same with an empty bobbin, then transferring the advancing yarn from the take-up spool on said carriage to the empty bobbin and so as to wind the yarn thereupon, and including severing the yarn between the take-up spool and empty bobbin, and then moving the mobile carriage to a position adjacent a different winding station and repeating the above steps.

2. The method as defined in claim 1 wherein the step of rotating the take-up spool includes rotating the spool at a winding speed closely corresponding to the speed of the yarn winding station.

3. The method as defined in claim 2 comprising the further step of traversing the yarn along the surface of the take-up spool during winding of the yarn thereon.

4. The method as defined in claim 3 wherein the steps of rotating the take-up spool and traversing the yarn include contacting the yarn wound on the spool with a driven roll having traversing grooves formed therein.

5. The method as defined in claim 1 comprising the further steps of monitoring the winding speed of the adjacent yarn winding station, and controlling the speed of said take-up spool as a function of the monitored speed so that the winding speed of the take-up spool closely corresponds to the winding speed of the adjacent yarn winding station.

6. The method as defined in claim 1 comprising the further subsequent step of measuring at least one quality control related physical characteristic of the yarn which has been wound on the take-up spool.

7. The method as defined in claim 1 comprising the further step of winding the yarn from a plurality of winding stations successively onto a common take-up spool, and so that yarn samples from the several stations are superposed on the take-up spool.

8. A method for continously removing waste yarn doffing of a textile yarn processing machine having a plurality of yarn winding stations arranged in horizontal tiers and vertically aligned columns, and wherein the yarns for all of the yarn winding stations are delivered in a vertical direction and from one vertical end of the apparatus, and wherein the yarn continues to advance during the doffing operation, and comprising the steps of moving a mobile carriage to a position adjacent a vertical column of yarn winding stations at the conclusion of the winding operation at such stations, concurrently transferring the advancing yarns of all of the winding stations in the adjacent vertical column to a take-up spool mounted on said carriage and which is generally aligned in front of the upstream yarn winding station, and while rotating the take-up spool at a winding speed closely corresponding to the winding speed of the adjacent yarn winding stations so as to wind all of the transferred yarns upon the spool, and further including severing each of the yarns between the winding stations and take-up spool, shifting the rotating take-up spool laterally in a direction parallel to the direction of the horizontal tiers of winding stations and so as to facilitate access to the adjacent column of yarn winding stations, and vertically shifting the rotating take-up spool in the downstream direction of the advancing yarns and so as to be generally aligned in elevation with the downstream yarn winding station, removing the full bobbins from all of the yarn winding stations on the adjacent column while the rotating take-up spool is shifted laterally, and replacing each of the full bobbins with an empty bobbin, transferring the advancing yarns from the rotating take-up spool to respective ones of the empty bobbins mounted on the adjacent column on yarn winding stations, and including severing each of the yarns between the take-up spool and winding stations, and then returning the take-up spool to its original location and moving the mobile carriage to a position adjacent a different column of yarn winding stations, and repeating the above steps.

9. The method as defined in claim 8 including the further step of traversing all of the advancing yarns in unison along the surface of the take-up spool during winding of the yarns thereupon.

10. The method as defined in claim 9 comprising the further subsequent step of measuring at least one quality control related physical characteristic of each of the yarns which have been wound on the take-up spool.

11. The method as defined in claim 8 wherein the step of transferring the advancing yarns from the rotating take-up spool to respective ones of the empty bobbins comprises laterally shifting the take-up spool so as to be again generally aligned with said column of yarn winding stations, and then moving the advancing yarns from the spool to said empty bobbins.

12. A method for continuously removing waste yarn during doffing of a textile yarn processing machine having a plurality of yarn winding stations and which permits the quality of the yarn being processed to be efficiently monitored, and comprising the steps of winding the advancing yarn being processed by each of a plurality of winding stations of the machine successively onto a common waste take-up spool during doffing of the full yarn package at each such station, at a winding speed closely corresponding to the winding speed of the associated winding station, and while traversing the yarn on the take-up spool, and so that yarn samples from the plurality of winding stations are superposed on the spool, and then measuring at least one quality control related physical characteristic of the yarn wound on the take-up spool.

13. The method as defined in claim 12 comprising the further step of correlating each of the yarn samples wound on the spool to a particular yarn package.

14. An apparatus for continuously removing waste yarn during doffing of a textile yarn processing machine having a plurality of yarn winding stations aligned along at least one side thereof and wherein the yarn continues to advance during the doffing operation, said apparatus comprising a mobile carriage adapted to be moved to a position adjacent a yarn winding station at the conclusion of the winding operation at such station, said carriage including a yarn take-up spool rotatably mounted thereon and means for rotating said spool, control means for monitoring the winding speed of the textile yarn processing machine and for controlling the winding speed of said take-up spool so as to closely correspond to the winding speed of the machine, whereby an advancing yarn from an adjacent winding station may be transferred to said take-up spool prior to doffing of the adjacent winding station, and transferred back to an empty bobbin at the adjacent winding station after doffing is completed, and the advancing yarn may be wound on the take-up spool during the doffing operation without interruption of the advance thereof.

15. The apparatus as defined in claim 14 wherein said means for rotating said spool includes a drive roll, and said apparatus further comprises means mounted on said carriage for traversing the advancing yarn along the surface of the spool during winding of the yarn thereon.

16. The apparatus as defined in claim 14 further comprising package doffing means operatively associated with said carriage for removing and receiving full yarn packages from the adjacent yarn processing machine.

17. The apparatus as defined in claim 14 wherein the textile yarn processing machine has a plurality ot yarn winding stations arranged in horizontal tiers and vertically aligned columns, and wherein said carriage includes a number of said take-up spools corresponding to the number of tiers and arranged in a horizontal juxtaposed relation.

18. An apparatus for continuously removing waste yarn during doffing of a textile yarn processing machine having a plurality of yarn winding stations aligned along at least one side thereof and wherein the yarn continues to advance during the doffing operation, said apparatus comprising a mobile carriage adapted to be moved to a position adjacent a yarn winding station at the conclusion of the winding operation at such station, said carriage including a yarn take-up spool rotatably mounted thereon and means for rotating said spool, means mounted on said carriage for transferring an advancing yarn from an adjacent winding station to said take-up spool prior to doffing of the adjacent winding station, and for transferring the advancing yarn from said spool to an empty bobbin at the adjacent winding station after doffing is completed, whereby the advancing yarn may be wound on the take-up spool during the doffing operation without interruption of the advance thereof.

19. The apparatus as defined in claim 18 wherein said means for rotating said spool includes control means for rotating the same at a winding speed which closely corresponds to the winding speed of the adjacent yarn winding station.

20. The apparatus as defined in claim 19 further comprising means mounted on said carriage for traversing the advancing yarn along the surface of the spool during winding of the yarn thereon.

21. The apparatus as defined in claim 20 wherein said means for rotating said spool includes a drive roll, and said traversing means comprises traversing grooves in said drive roll.

22. The apparatus as defined in claim 21 wherein said carriage further includes means for moving said take-up spool laterally with respect to the adjacent yarn winding station and during winding of the advancing yarns thereon, and so as to facilitate the subsequent doffing of the full package at the adjacent yarn winding station.

* * * * *